US006209325B1

(12) United States Patent
Alkabie

(10) Patent No.: US 6,209,325 B1
(45) Date of Patent: Apr. 3, 2001

(54) COMBUSTOR FOR GAS- OR LIQUID-FUELED TURBINE

(75) Inventor: Hisham S Alkabie, Sudbrooke (GB)

(73) Assignee: European Gas Turbines Limited (GB)

( * ) Notice: Subject to any disclaimer, the term of this patent is extended or adjusted under 35 U.S.C. 154(b) by 0 days.

(21) Appl. No.: 08/820,310

(22) Filed: Mar. 18, 1997

(30) Foreign Application Priority Data

Mar. 29, 1996 (GB) ..... 9606628

(51) Int. Cl.[7] ..... F23R 3/34; F02C 3/14

(52) U.S. Cl. ..... 60/737; 60/747; 60/760; 60/756; 60/748

(58) Field of Search ..... 60/737, 733, 747, 60/748, 752, 756, 760, 746

(56) References Cited

U.S. PATENT DOCUMENTS

| | | | | |
|---|---|---|---|---|
| 3,016,703 | * | 1/1962 | Lorett | 60/760 |
| 3,333,414 | * | 8/1967 | Saintsbury | 60/760 |
| 4,112,676 | * | 9/1978 | DeCorso | 60/733 |
| 4,928,481 | | 5/1990 | Joshi et al. | 60/737 |
| 5,069,029 | * | 12/1991 | Kuroda et al. | 60/39.06 |
| 5,121,597 | * | 6/1992 | Urushidani et al. | 60/39.06 |
| 5,257,499 | * | 11/1993 | Leonard | 60/39.23 |
| 5,319,935 | * | 6/1994 | Toon et al. | 60/733 |
| 5,394,688 | * | 3/1995 | Amos | 60/39.23 |
| 5,584,684 | * | 12/1996 | Dobbeling et al. | 431/285 |
| 5,802,854 | * | 9/1998 | Maeda et al. | 60/737 |

FOREIGN PATENT DOCUMENTS

| | | |
|---|---|---|
| 0 281 961 A1 | 9/1988 | (EP) . |
| 2 287 312 | 9/1995 | (GB) . |

* cited by examiner

*Primary Examiner*—Ted Kim
(74) *Attorney, Agent, or Firm*—Kirschstein, et al.

(57) ABSTRACT

The combustor has three injection stages to supply fuel or a fuel/air mixture progressively to a pre-chamber or a main combustion chamber wherein the third injection stage comprises an elongated passage with an arrangement for introducing fuel into the passage. Preferably the passage extends alongside the combustion chamber and/or another passage for cooling air.

20 Claims, 6 Drawing Sheets

COMBUSTOR FOR GAS- OR LIQUID-FUELED TURBINE

BACKGROUND OF THE INVENTION

This invention relates to a combustor for a gas- or liquid-fueled turbine.

A turbine engine typically includes an air compressor, at least one combustor and a turbine. The compressor supplies air under pressure to the combustor(s)—a proportion of the air is mixed with the fuel, while the remaining air supplied by the compressor is utilized to cool the hot surfaces of the combustor and/or the combustion gases, (i.e., the gases produced by the combustion process, and/or other components of the turbine plant).

With the aim of reducing the amount of pollutants produced by the combustion process (particularly $No_x$), lean burn combustors have been proposed. Such combustors involve the premixing of air and fuel, with a relatively low proportion of fuel being utilized. Combustion then occurs at relatively low temperatures, which reduces the amount of pollutants produced. However, in their basic form such lean burn combustors have a narrow operating range, i.e. they cannot work satisfactorily with large variations in the quantity of fuel being supplied, and are susceptible to flame blow-out or flash-back.

One known solution aimed to overcome difficulties inherent in this type of combustor is to stage the air and/or fuel supply relative to engine load, for example, so that optimum flow and mixture rates are achieved over the whole operating range. Stage combustors have, in the past, taken various designs, from those of fixed geometry which may have a number of burners and to which fuel is selectively directed depending on engine requirements, to those of a more complicated nature which may have movable parts to control the flow of combustion air.

The present invention seeks to provide a three stage combustor of relatively simple construction but which is nonetheless effective in minimizing the production of pollutants resulting from the combustion process and, in addition, operates with good combustion stability and an excellent turndown ratio whilst at the same time giving flashback-free combustion.

SUMMARY OF THE INVENTION

According to the invention, there is provided a combustor for a gas- or liquid-fueled turbine comprising a main combustion chamber and a pre-chamber, a first injection means for supplying fuel or a fuel/air mixture to the pre-chamber, a second injection means for supplying air or a fuel/air mixture to the pre-chamber, a third injection means for supplying air or a fuel/air mixture to the main combustion chamber, the first, second and third injection means being operable progressively in sequence to provide fuel or a fuel/air mixture for combustion; and wherein the third injection means comprises at least one elongated passage means with an arrangement for introducing fuel into the passage means.

The combustion chamber and the pre-chamber are preferably defined by one or more cylindrical walls whereby the pre-chamber and the combustion chamber are each of cylindrical form, and with the cross-sectional area of the combustion chamber being greater than the cross-sectional area of the pre-chamber. Preferably, a transition region is defined between the pre-chamber and the combustion chamber.

The arrangement for introducing fuel into the passage means may comprise a spray bar.

Preferably at least part of the length of the passage means extends alongside the combustion chamber over at least part of the length of the combustion chamber. Further, at least part of the length of a passage for cooling air may extend alongside the combustion chamber over at least part of the length of the combustion chamber.

The elongated passage means may be of generally annular form having a radially inner wall and a radially outer wall, the radially inner wall being constituted at least partly by a wall defining the combustion chamber.

It is also envisaged that said elongated passage means and said passage for cooling air may both be of annular form with the passage for cooling air being situated radially outside the combustor chamber and the passage means being situated radially outside the passage for cooling air.

The axial direction of flow of fuel/air mixture in the elongated passage means may be counter to the axial direction of flow of cooling air in the passage therefor.

Alternatively the flow of fuel/air mixture in the elongated passage means may be in the same direction as the flow of cooling air in the passage therefor.

The passage means may include turbulence inducing means, which may comprise at least one tube extending between the walls defining the passage means. The or each tube may be open-ended and provide means for entry of cooling air from outside the combustor to the passage for cooling air.

The interior of the wall or walls defining the combustion chamber and the pre-chamber may have a thermal barrier coating applied thereto.

At least one of the walls defining the elongated passage means may be of corrugated section.

In a preferred arrangement the first injection means provides an air/fuel mixture with local fuel rich areas.

The second injection means may comprise a fuel spray bar, an air inlet means, and a chamber in which mixing of the fuel and air takes place.

When a passage for coolant air is provided it is envisaged that coolant air will pass from the passage into the interior of the combustor; at least a part of the coolant air may pass into the combustion chamber through at least one orifice adjacent the downstream region thereof, and/or at least a part of the coolant air may pass into the interior of the combustor through at least one orifice in a transition duct region.

BRIEF DESCRIPTION OF THE DRAWINGS

Embodiments of the invention will be described, by way of example, with reference to the accompanying drawings in which.

DETAILED DESCRIPTION OF THE EMBODIMENTS OF THE INVENTION

The combustor may be embodied in any conventional turbine layout, e.g., tubular (single-can or multi-can), turboannular or annular.

Figure 1:
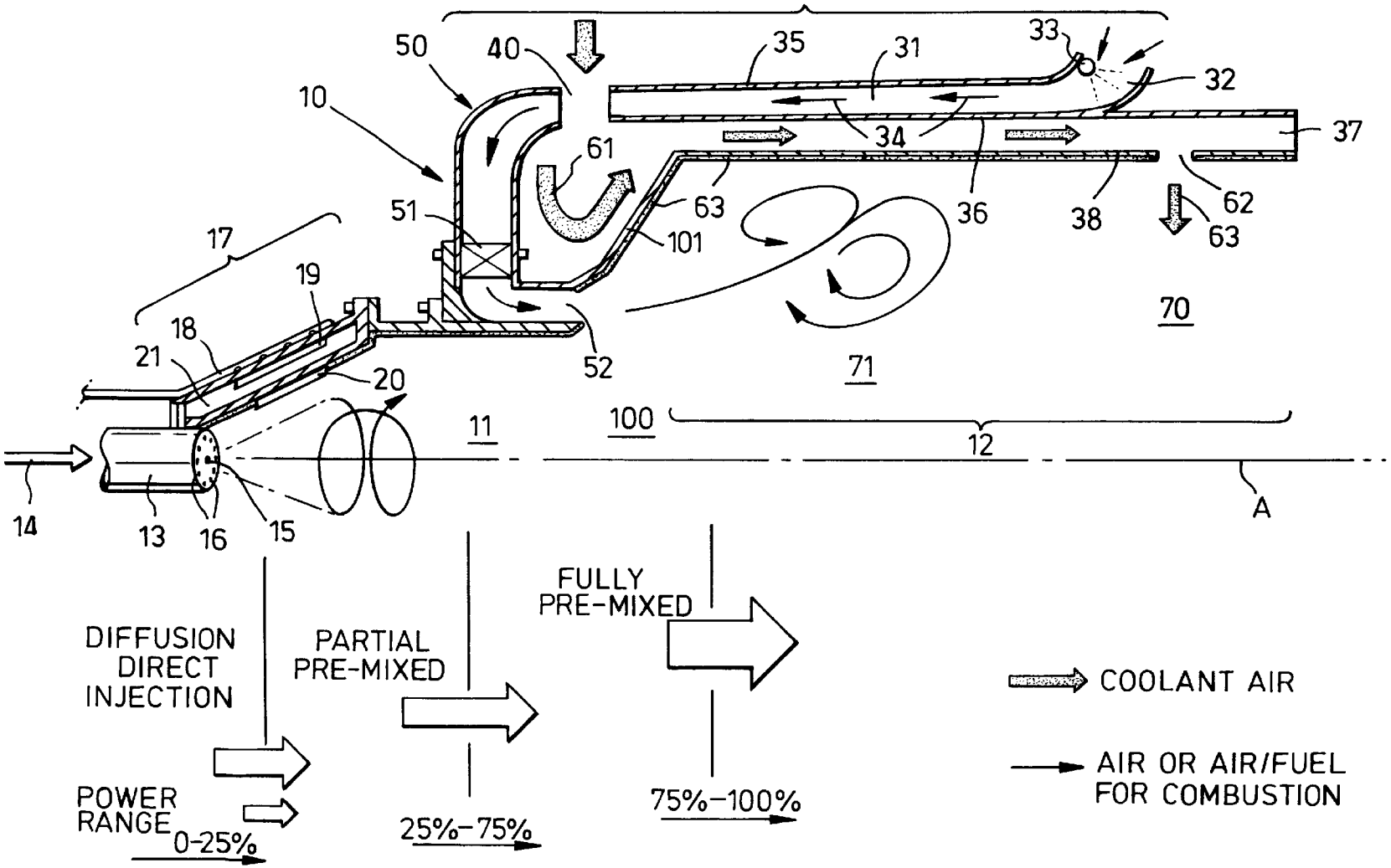
FIGS. 1–5 show diagrammatic axial half-sections through five separate embodiments of "can-type" combustors according to the invention.

Thus, the combustor 10 as illustrated in FIG. 1 is of generally circular cylindrical form with a central longitudinal axis marked by line "A" and as indicated above the combustor 10 may, for example, constitute one of a plurality of such combustors arranged in an annular array. The combustor has a pre-chamber 11 and a main combustion chamber 12. The diameter of the major part of the main combustion chamber 12 is substantially greater than that of the pre chamber 11 with the transition region 100 between the chamber 11 and the chamber 12 being defined by a wall 101 of the combustor diverging in the downstream direction. At the upstream end of the combustor 10 is provided a first injection means 13 which is located co-axially of axis A.

The injection means 13 is provided with a supply of fuel (or a supply of fuel and air) as represented by the arrow 14, which supply is discharged into the pre-chamber 11. It is to be noted that the fuel may be gas or liquid. The injection means 13 which may be of dual fuel type provides a fuel/air mixture in the pre-chamber 11 which, although of overall lean constitution, nevertheless has local fuel-rich areas. This is achieved by the injection means 13 incorporating or having associated therewith appropriate mixing means. For example, if a fuel/air mixture is supplied to the injection means 13 at its upstream end the injection means may incorporate a swirl means to give the mixture the appropriate degree of mixing as delineated above—such swirl means may involve vanes and/or suitably angling of passage(s) through the means. If fuel alone is injected into the pre-chamber 11 by the injection means 13 then some means will be provided whereby air in the pre-chamber (see later) is mixed with the fuel to give the appropriate form of mixture.

The injection means 13 as diagrammatically represented comprises a circular cylindrical member formed with a plurality of passages therethrough. In one form a central passage 15 acts to supply fuel to pre-chamber 11 whilst an annular array of passages 16 supply (swirled) air to mix with the fuel in pre-chamber 11. In use, injection means 13 acts as a first stage injection means or burner being supplied with fuel 14 (or fuel/air) for engine starting and being the only fuel source up to an engine load of approximately 25%. Because the otherwise lean mixture has local fuel rich areas, flame stability in the pre-chamber 11 is assured at these low power settings.

Mounted to extend generally radially outwardly from injection means 13 is a second stage injection means 17. The second stage injection means 17 may extend orthogonally of injection means 13 or at an angle thereto. In this particular embodiment, the injection means 17 is designed as one of four mounted on the interior surface of an annular or frusto-conical wall extending from injection means 13. Each injection means 17 comprises a fuel spray bar 18, with a respective air inlet slot 19 extending therealongside: a respective mixing chamber 21 and a respective air/fuel outlet slot 20 are associated with the spray bar 18 and air inlet slot 19. By suitable arrangement of the spray bar 18 and slots 19, 20, the fuel and air are caused to contra-rotate in chamber 21 to give a mixture which is largely but not fully uniform in its air to fuel distribution. The injection means 17 thereby acts as a partial premix device. The direction of mixture issuing from the outlet slot 20 is arranged to be such that thorough mixing with the mixture supplied by the first injection means 13 is obtained but it must also be arranged that the velocity of the combined mixture is not reduced to the extent that flash-back might occur.

The second injection means 17 is operated to supply fuel for combustion between approximately 25% and 75% of engine local, which fuel is added to that which has already been supplied by the first injection means 13. From approximately 75% to 100% engine load the fuel for combustion already supplied by the first injection means 13 and the second injection means 17 is supplemented by fuel supplied by a third injection means 30.

The third injection means 30 is arranged to deliver fuel/air mixture into the upstream region of the main combustion chamber 12 optionally via the transition region 100, such fuel/air mixture being fully pre-mixed, i.e., the fuel and air are substantially evenly distributed.

As shown, the third injection means 30 comprises an elongated passage 31 with an inlet 32 for air and including a fuel spray bar 33, the air and fuel mixing as they pass along the passage as indicated by arrows 34 in an axial direction counter to the axial direction of flow of gases in the combustion chamber 12. The passage 31 is formed radially outside the main combustion chamber 12. The passage may be of annular form totally surrounding the combustion chamber 12 or there may be one or more separate cylindrical passages 31 running alongside the combustion chamber 12. As shown the passage 31 is of annular form being formed between an annular sleeve 35 and the outer wall 36 of an annular passage 37 for cooling air surrounding the combustion chamber 12 and to be described in detail later.

Figure 6:
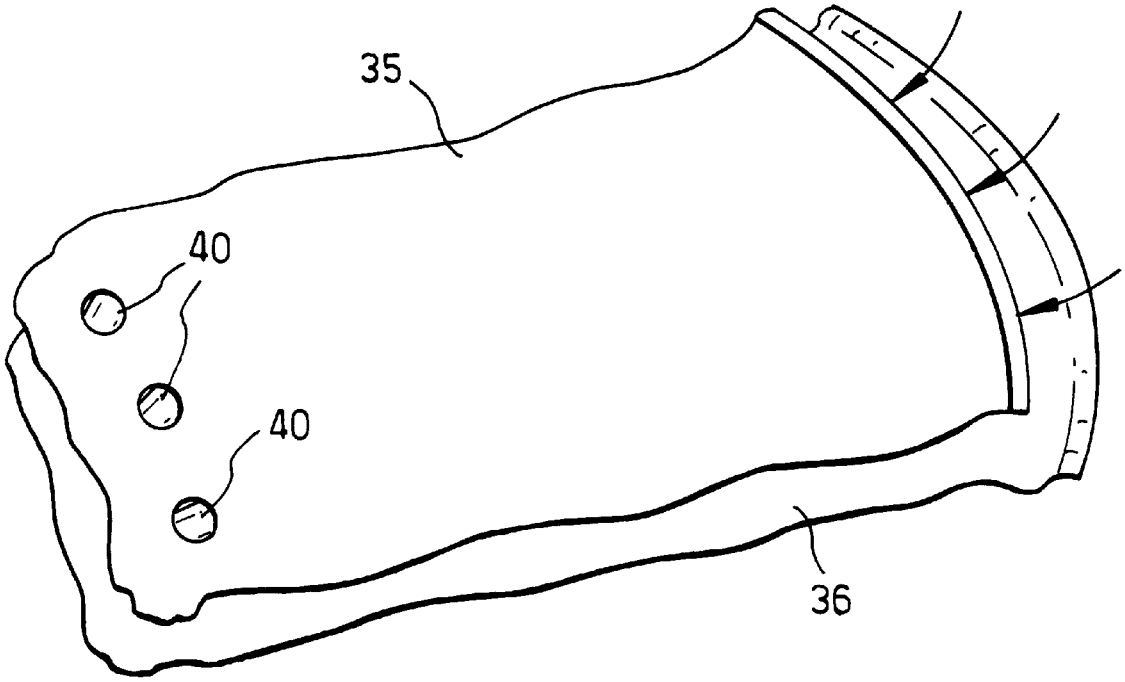
FIGS. 6 and 7 show detailed views of a turbulence inducing means, for use with any of the embodiments of FIGS. 1–5.
Figure 7:
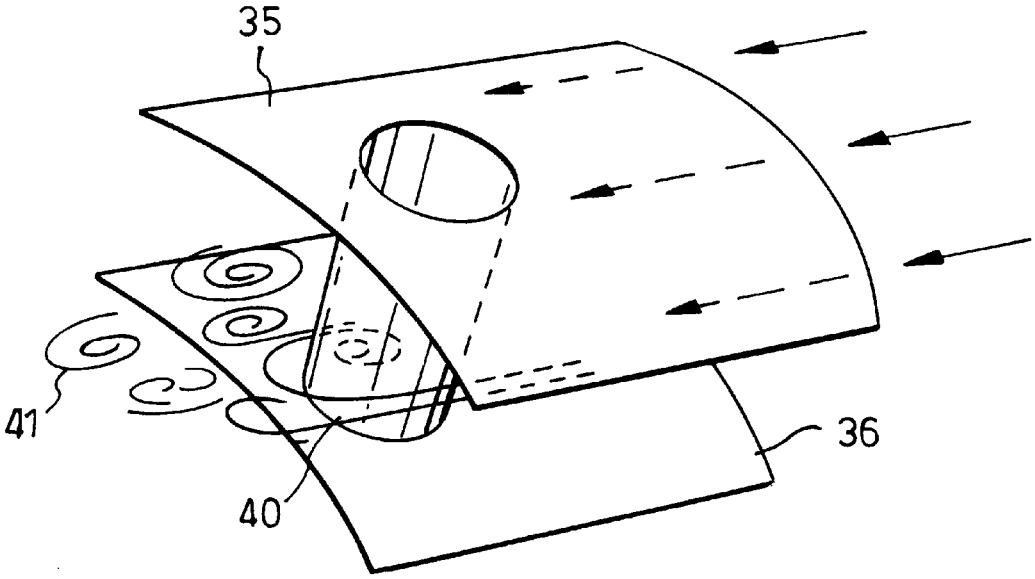

As indicated above the passage 31 is relatively long which assists mixing of the air and fuel but in addition it may incorporate further means for creating turbulence to assist the mixing process. Such turbulence creating means may comprise vanes but, as shown, it comprises one or more open-ended tubes 40 extending across annular passage 31 between walls 35, 36. Not only do these tubes 40 promote turbulence but they also act as entry conduits for cooling air. FIGS. 6, 7 show details of the form and positioning of these tubes and arrows 41 indicate the swirling motion of the fuel air mixture as promoted by tube 40.

The walls 35, 36 are curved radially inwardly through a right angle as indicated at 50 so that the passage 31 is continued radially inwardly; this part of the passage includes one or more swirlers 51 immediately upstream of an outlet 52 which is arranged such that it directs the fully mixed air/fuel mixture axially into the combustion chamber 12 (optionally via transition region 100) at its upstream end. Once again, it has to be arranged that the mixture issuing from outlet 52 has a velocity sufficient to prevent flash-back.

As indicated above, the combustor involves cooling arrangements utilizing cooling air. The cooling air is supplied by the compressor of the gas turbine plant, with a certain percentage of air being supplied for combustion purposes and the remainder for cooling.

The flow of cooling air in the illustrated embodiment is indicated by arrows 61. The combustion chamber is, in this embodiment, formed with a double wall whereof the radially outer wall 36 also constitutes the inner wall of the supply passage 31 and the radially inner wall 38 of passage 37 constitutes the axially extending wall of the combustion chamber 12. The cooling air enters passage 37 via the open-ended tubes 40 and enters the combustion chamber 12 via orifices 62 in wall 38. The wall 38 and its continuation 101, which is attached to or integral with wall 38, have a thermal barrier coating 63 on their interior surfaces as marked by dash lines. This barrier coating 63 restricts the heat passing through to the walls 38, 101 from where it is removed by the cooling air flow 61 flowing in passage 37 whereby the metal, of which walls 38, 101 are made, operates within its temperature limit. The spent and now heated cooling air enters the combustion chamber 12 (see arrow 63) in a dilution zone 70 downstream of the main combustion zone 71. By such means heat taken out of the system at one point is usefully put back at another—such an arrangement is termed regenerative.

It should further be noted there is also transfer of heat from the cooling air flow 61 in passage 37 to the air/fuel mixture in passage 31. This preheating of the mixture is useful in avoiding a quenching effect that might result if too cold a mixture is fed into the combustion chamber 12 (such quenching may result in the production of unwanted CO). Of course it must be ensured that not too much heat is transferred to passage 31, otherwise there is a danger of mixture ignition in the passage 31 itself.

It should be noted that in the case of a single wall combustor where there is no annular passage 37 for flow of cooling air, the inner wall of passage 31 will be constituted by the single wall 38 of the combustor, and heat will be transferred straight from the combustion chamber 12 to the air/fuel mixture in passage 31.

Figure 2:
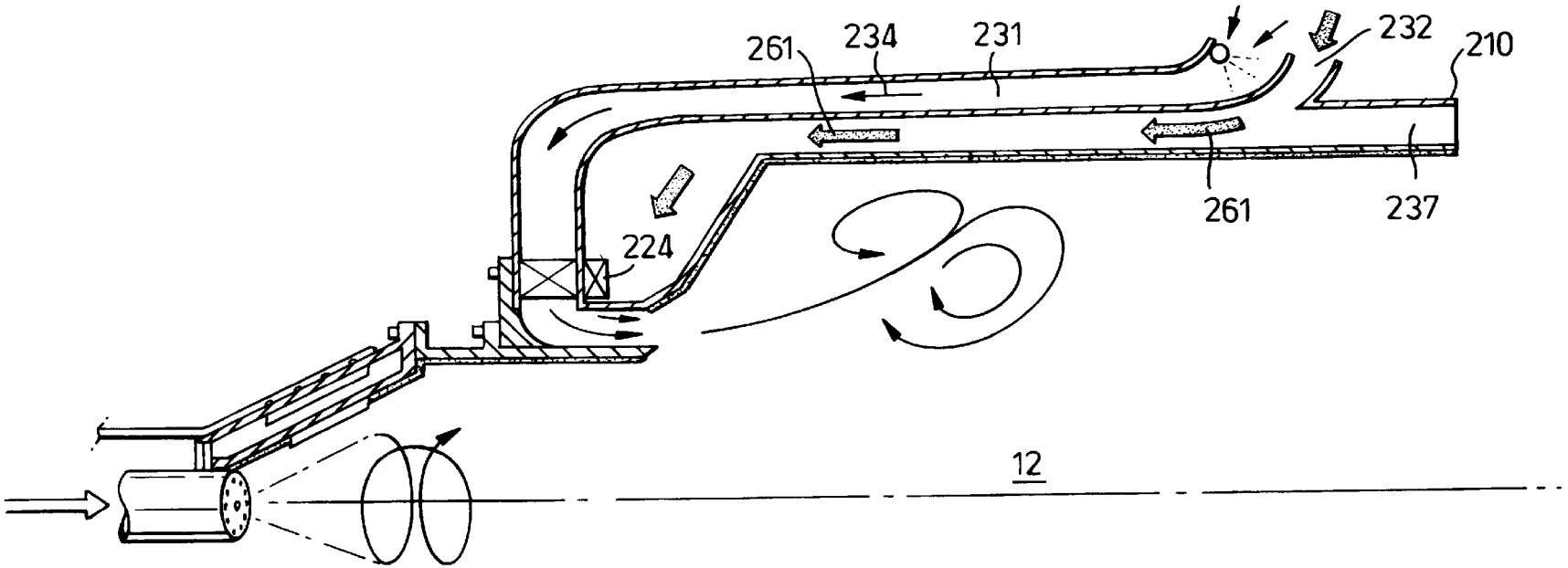

The embodiment of FIG. 2 differs from FIG. 1 inasmuch as the cooling air flow represented by arrows 261 enters passage 237 through an inlet 232 adjacent the downstream end of the combustor 210 and flows towards the upstream end of combustion chamber 12 where it enters the combustion chamber via a swirler 224. In this arrangement, therefore, as compared with that of FIG. 1 there is no dilution air supplied to the combustion gases at the downstream end of the combustion chamber 12 but rather additional air is added to the fuel/air mixture. It is to be noted that in this embodiment the coolant air in passage 237 flows in the same axial direction as the fuel/air mixture represented by arrows 234 flowing in passage 231. This means that there will be less heat transfer into the mixture 234, than in the arrangement of FIG. 1, and less chance of ignition in passage 231.

Figure 3:
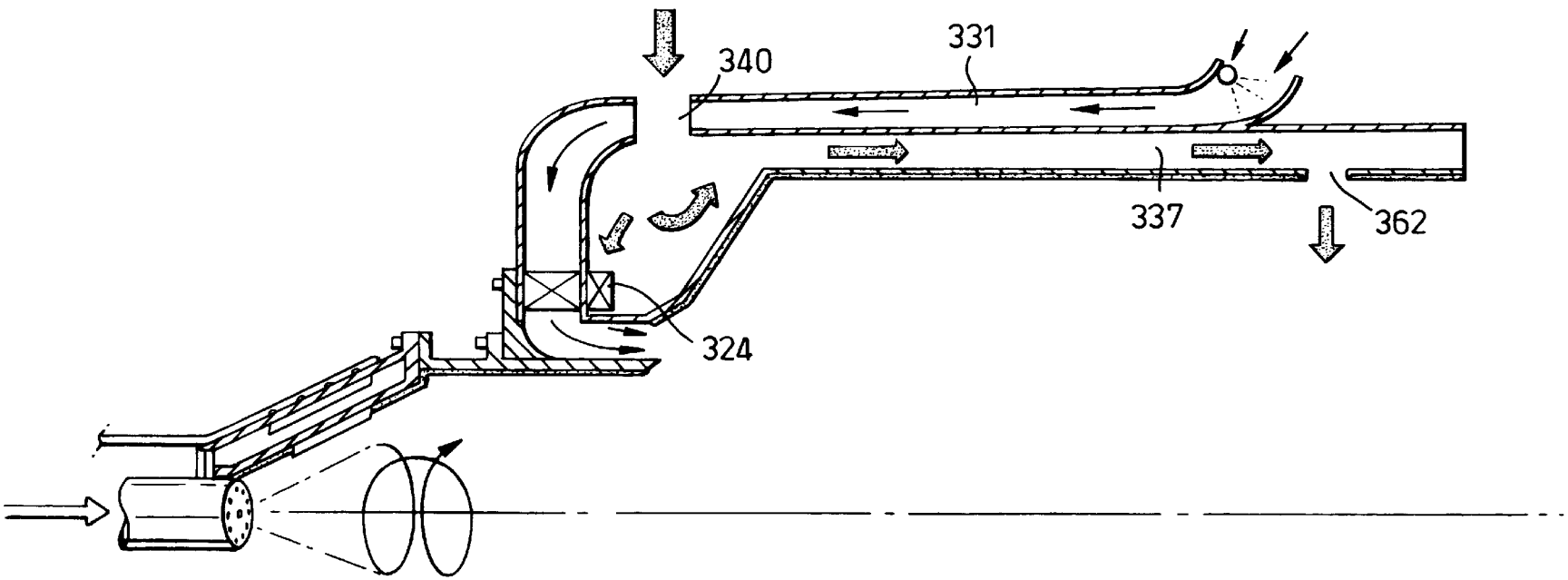

In the embodiment of FIG. 3, features of the embodiments of FIGS. 1 and 2 are effectively combined in that the cooling air enters passage 337 through open-ended tubes 340 that extend through passage 331 of the third injection means. Some of this air flows through passage 337 to enter the combustion chamber 12 at the downstream end thereof while the rest of the air flows into the upstream end of the combustor chamber 12 through a swirler 324.

Figure 4:
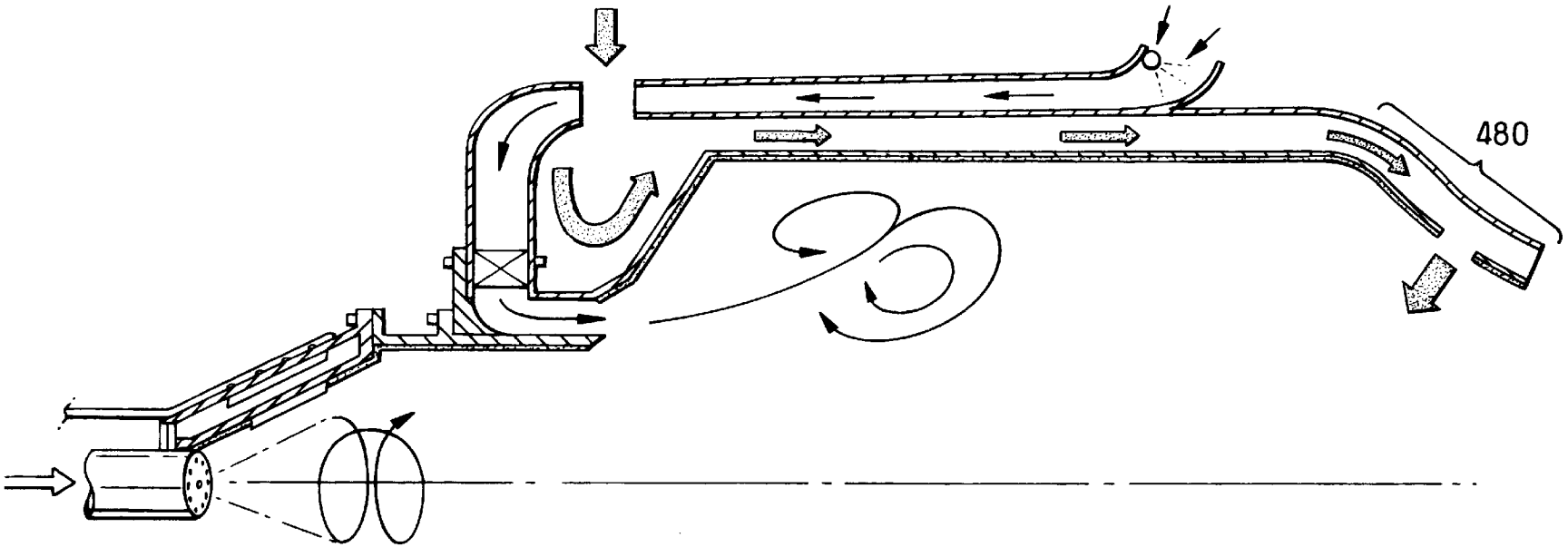

The embodiment of FIG. 4 is generally similar to that of FIG. 1 save that the dilution air enters a combustor/turbine transition duct region 480 downstream of the main combustion chamber 12. This may result in better temperature profiling of the combustion gases in certain circumstances.

Figure 5:
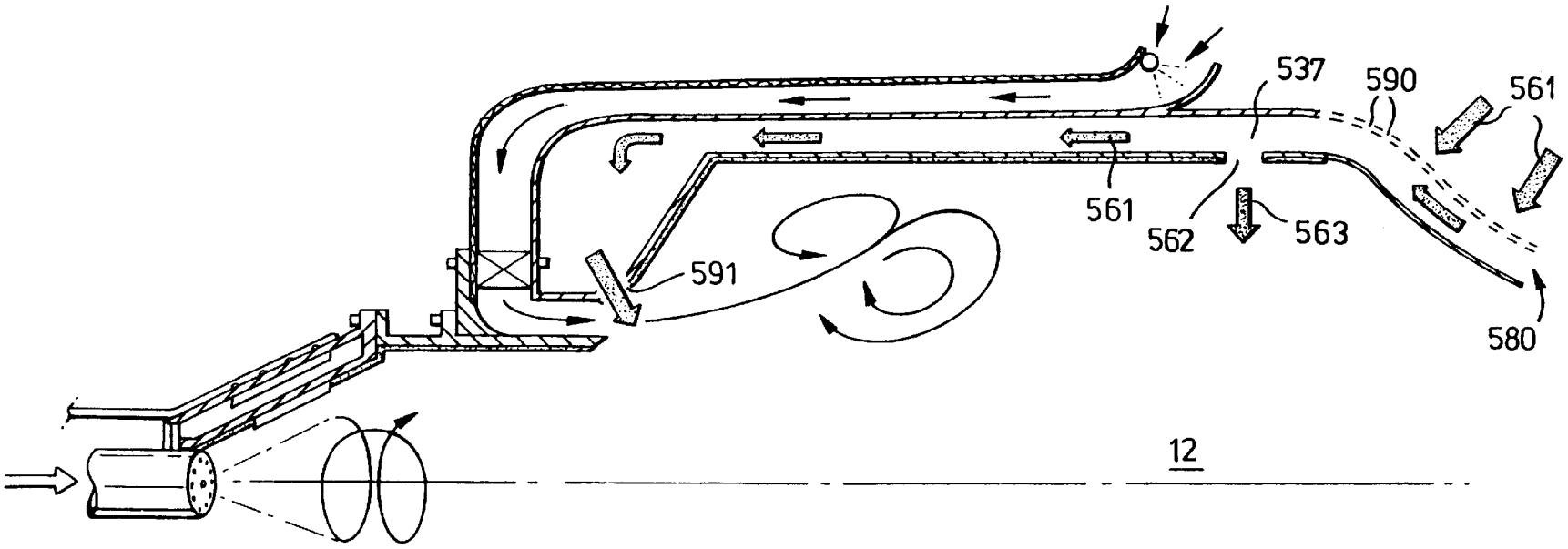

In the embodiment of FIG. 5, the cooling air represented by arrows 561 enters the annular passage 537 through impingement holes 590 provided in the transition duct region 580 and flows into the combustion chamber 12 through orifices 562 in the direction of arrow 563 to dilute the combustion gases and is also directed into the upstream end of the chamber 12 through orifices 591.

I claim:

1. A combustor for a turbine, comprising:

a) a pre-chamber having a cross-section;

b) a first injection stage for supplying a first proportion of a combustible along a flow direction to the pre-chamber for combustion therein;

c) a second injection stage for supplying a second proportion of the combustible to the pre-chamber downstream of the first injection stage for combustion in the pre-chamber;

d) a main combustion chamber in fluid flow communication with the pre-chamber downstream of the pre-chamber, the main chamber having a cross-section larger than the cross-section of the pre-chamber to define a transition region, the main chamber having a length as considered along the flow direction;

e) a cooling air passage extending along at least a part of the length of the main chamber and being in a heat-exchanging relationship with the main chamber; and f) a third injection stage for supplying a third proportion of the combustible to the transition region for combustion in the transition region and in the main chamber, the third injection stage including an injection passage extending along at least a part of the length of the main chamber and being in a heat-exchanging and surrounding relationship with the cooling air passage and, in turn, with the main chamber to heat the third portion of the combustible prior to being supplied to the transition region.

2. The combustor as claimed in claim 1, wherein the first injection stage includes a fuel injector for injecting a fluid fuel to the pre-chamber.

3. The combustor as claimed in claim 2, wherein the first injection stage includes an air injector for injecting air into the fluid fuel to form a combustible mixture.

4. The combustor as claimed in claim 3, wherein the fuel injector includes a central passage through which the fluid fuel is supplied, and wherein the air injector includes a plurality of outer passages through which the air is supplied, and wherein the outer passages are arranged in an annular array surrounding the central passage.

5. The combustor as claimed in claim 1, wherein the second injection stage includes a sprayer for spraying a combustible mixture of fluid fuel and air into the pre-chamber.

6. The combustor as claimed in claim 1, wherein the transition region is bounded by a wall which diverges away from the pre-chamber along the flow direction.

7. The combustor as claimed in claim 1, wherein the injection passage is elongated and has an inlet and an outlet at opposite end regions of the injection passage, and wherein the second injection stage includes a mixer at an inlet end region, for mixing a combustible mixture of fluid fuel and air, and wherein an outlet end region is in fluid communication with the transition region.

8. The combustor as claimed in claim 7, wherein the third injection stage includes a swirler at the outlet end region for swirling the combustible mixture.

9. The combustor as claimed in claim 7, wherein the inlet end region is located downstream of the outlet end region as considered along the flow direction, and wherein the third injection stage supplies the third proportion of the combustible along a countercurrent direction to the flow direction.

10. The combustor as claimed in claim 7, wherein the third injection stage includes means within the injection passage intermediate said end regions, for creating turbulence in the combustible mixture.

11. The combustor as claimed in claim 10, wherein the turbulence creating means is a tube extending across the injection passage, for admitting turbulent air into the injection passage.

12. The combustor as claimed in claim 1, wherein the cooling air passage is elongated and has a cooling inlet for admitting cooling air into the cooling air passage, and a cooling air outlet for discharging cooling air from the cooling air passage, the cooling air inlet and the cooling air outlet being located at opposite end regions of the cooling air passage.

13. The combustor as claimed in claim 12, and further comprising a cooling swirler in the cooling air passage, for swirling the cooling air.

14. The combustor as claimed in claim 12, wherein the cooling air outlet is in fluid communication with the main chamber at a dilution region downstream of the transition region.

15. The combustor as claimed in claim 12, wherein the cooling air outlet is in fluid communication with the main chamber at the transition region.

16. The combustor as claimed in claim 12, wherein the cooling air inlet extends across the injection passage.

17. The combustor as claimed in claim 1, wherein said part of the cooling air passage is contiguous with, and external to, the main chamber.

18. The combustor as claimed in claim 17, wherein said part of the injection passage is contiguous with, and external to, said part of the cooling air passage.

19. The combustor as claimed in claim 1, and further comprising a thermal barrier coated on walls bounding the pre-chamber and the main chamber.

20. The combustor as claimed in claim 1, wherein the injection passage is bounded by a corrugated wall.

* * * * *